US005809703A

United States Patent [19]

Kelly

[11] Patent Number: 5,809,703

[45] Date of Patent: Sep. 22, 1998

[54] SLOTTED INSERT WITH INCREASED PULL-OUT CAPACITY

[75] Inventor: David L. Kelly, Sacramento, Calif.

[73] Assignee: MMI Products, Inc., Houston, Tex.

[21] Appl. No.: 783,576

[22] Filed: Jan. 15, 1997

[51] Int. Cl.[6] ..... E04B 1/38; E02D 35/00

[52] U.S. Cl. ..... 52/125.5; 52/704; 52/707

[58] Field of Search ..... 52/124.2, 125.1, 52/125.5, 704, 707–710, 741.1, 745.21

[56] References Cited

U.S. PATENT DOCUMENTS

| | | | |
|---|---|---|---|
| 1,022,826 | 4/1912 | Chatfield | 52/704 X |
| 1,285,202 | 11/1918 | Jaques et al. | 52/707 X |
| 1,341,585 | 5/1920 | Pool | 52/707 X |
| 1,491,571 | 4/1924 | Tomkinson et al. | 52/704 X |
| 1,750,841 | 3/1930 | Hopper et al. . | |
| 1,768,246 | 6/1930 | Gaddis | 52/708 |
| 1,769,498 | 7/1930 | Downing . | |
| 1,922,479 | 8/1933 | Joshlin | 52/704 X |
| 1,929,835 | 10/1933 | Awbrey . | |
| 1,948,093 | 2/1934 | Baird et al. | 52/704 |
| 2,133,134 | 10/1938 | Davis . | |
| 2,199,533 | 5/1940 | Wuellner | 52/704 X |

(List continued on next page.)

FOREIGN PATENT DOCUMENTS

| | | | |
|---|---|---|---|
| 664178 | 6/1963 | Canada | 72/70 |
| 0568 934 A2 | 11/1993 | European Pat. Off. | 1/66 |
| 88 13 349.4 | 2/1989 | Germany . | |
| 39 31 494 A1 | 4/1991 | Germany . | |
| 2 103 749 A | 2/1983 | United Kingdom . | |
| 21 140 118 | 11/1984 | United Kingdom . | |

OTHER PUBLICATIONS

Sales Brochure entitled: "Burke Corewall Slotted Inserts," The Burke Company, [6 sides], May 1990.

Sales Brochure entitled: "PSA Slotted Inserts," [2 sides], Paton Steenson Assoc.

Sales Brochure entitled: "Finally, The First Multi–Directional Insert," [4 sides], Connection Specialties, inc.

Sales Brochure entitled: "The One Insert That Makes Both Connections.," [5 sides], Lancaster Malleable Castings Co. (1991).

Sales Brochure entitled: "Inserts and Anchors," illustrating malleable adjustable inserts and peerless wedge inserts, [1 side], The Burke Group.

Illustration of Halfen Anchors entitled: "Comparison of Halfen Anchor Channel Loads," [1 side], The Burke Group.

European Search Report, Apr. 24, 1986.

*Primary Examiner*—Robert Canfield

*Attorney, Agent, or Firm*—Limbach & Limbach L.L.P.

[57] ABSTRACT

A slotted insert having a U-shaped frame and a plastic nut box forms a concrete cone having a depth which is substantially equal to the height of the insert by utilizing tapered feet. The interior sidewalls of the U-shaped frame are formed with indentations or through holes, and the plastic nut box is formed with first projections that are in register with and held by the indentations or through holes. As a result, assembly of the nut box into the frame is accomplished by snapping the nut box into the frame. The nut box, which is also formed with a second projection that fits within the slot of the insert, is formed from a lid that is plastic welded to an open box.

32 Claims, 6 Drawing Sheets

U.S. PATENT DOCUMENTS

| | | | |
|---|---|---|---|
| 2,280,080 | 4/1942 | Predan . | |
| 2,886,370 | 5/1959 | Liebert | 294/89 |
| 2,952,947 | 9/1960 | White | 52/704 |
| 2,954,647 | 10/1960 | Lee | 52/707 |
| 3,095,672 | 7/1963 | Di Tullio et al. | 52/704 |
| 3,449,883 | 6/1969 | Skubic et al. . | |
| 3,514,917 | 6/1970 | Merrill | 52/704 |
| 3,640,328 | 2/1972 | Tummarello | 151/41.7 |
| 3,652,118 | 3/1972 | Goldberg | 294/89 |
| 3,715,851 | 2/1973 | Bennett | 52/707 |
| 3,883,170 | 5/1975 | Fricker et al. | 294/83 R |
| 4,173,856 | 11/1979 | Fricker | 52/125 |
| 4,296,909 | 10/1981 | Haeussler | 249/94 |
| 4,367,892 | 1/1983 | Holt | 294/89 |
| 4,580,378 | 4/1986 | Kelly et al. | 52/125.5 |
| 4,618,464 | 10/1986 | Ditcher | 264/35 |
| 4,644,727 | 2/1987 | Hanson et al. | 52/687 |
| 4,702,045 | 10/1987 | Fricker | 52/125.4 |
| 4,719,724 | 1/1988 | Ditcher | 52/20 |
| 4,729,705 | 3/1988 | Higgins | 411/82 |
| 4,752,153 | 6/1988 | Miller | 404/59 |
| 4,831,796 | 5/1989 | Ladduwahetty | 52/704 X |
| 4,905,444 | 3/1990 | Semaan et al. | 52/710 |
| 4,930,269 | 6/1990 | Kelly et al. | 52/125.5 |
| 5,257,490 | 11/1993 | Endo et al. | 52/511 |
| 5,596,846 | 1/1997 | Kelly | 52/125.2 |
| 5,623,804 | 4/1997 | Kelly et al. | 52/704 |
| 5,625,993 | 5/1997 | Kelly | 52/704 |

SLOTTED INSERT WITH INCREASED PULL-OUT CAPACITY

BACKGROUND OF THE INVENTION

1. Field of the Invention

The present invention relates to slotted inserts for embedment in concrete and, more particularly, to a U-shaped slotted insert with tapered feet for increased pull-out capacity.

2. Description of the Related Art

A slotted insert is an attachment device which is conventionally embedded in a concrete structure, such as a precast panel, to allow heavy loads to be connected to the concrete structure. For example, slotted inserts commonly carry nuts which allow other structures, such as heavy pipes or equipment, to be attached to the concrete structure via bolts or other threaded members.

FIG. 1 shows a perspective view that illustrates a prior art nut-carrying slotted insert 10. As there shown, slotted insert 10 includes an insert frame 12, a nut member 14 connected to insert frame 12, and a nut 16 positioned between insert frame 12 and nut member 14.

As further shown in FIG. 1, insert frame 12 includes a base wall section 18 with a slotted opening 20, a pair of sidewalls 22 that extend away from base wall section 18 at an angle, and a flange section 24 that extends away from each of the sidewalls 20 along a plane substantially parallel with the plane of base wall section 18.

Nut member 14, in turn, is welded to base wall section 18 and sidewalls 22 to form a nut box that slidably carries nut 16 to provide flexibility in attaching bolts or other threaded members to nut 16. A plastic cover 26 can optionally be placed over the slotted opening 20 to protect nut 16 and the interior of the nut box.

FIGS. 2A–2C show a plan view, a side view, and an end view, respectively, that illustrate insert 10 embedded in a concrete section 28. When embedded in concrete, the maximum load that insert 10 can support along an axis normal to the plane of base wall section 18, which is known as the pull-out capacity, is defined generally by the strength of the concrete and the depth D of a concrete cone C. As shown in FIGS. 2A–2C, concrete cone C defines the amount of concrete which must be sheared away from the remaining concrete to extract insert 10 from the concrete.

In thick concrete applications, the depth D of concrete cone C can be varied by simply varying the height X of insert 10. In other words, the greater the height X of insert 10, the greater the depth D of concrete cone C.

However, in flush mounted applications, where both the top and bottom surfaces of insert 10 are flush with the top and bottom surfaces of the concrete, the depth D of concrete cone C is reduced by the thickness of flange 24. As shown in FIG. 2C, the depth D of concrete cone C is not equivalent to the thickness T1 of concrete section 28, but differs from the thickness T1 of concrete section 28 by the thickness T2 of flange 24.

The amount of force required to shear away concrete cone C is a function of the square of the depth of concrete cone C. Thus, even relatively small increases in the depth D of concrete cone C significantly increase the pull-out capacity of the insert.

For example, if the depth D of concrete cone C is two inches and the thickness T2 of flange 20 is one-quarter inch, insert 10 provides over 20% less pull-out capacity ($2^2$=4 vs. $2.25^2$=5.062) than could be achieved if the depth D of cone C were not limited by the thickness T2 of flange 24.

Another limitation of insert 10 is that insert 10 requires careful attention during installation. The conventional approach to installing inserts is to place the insert into the concrete after the concrete has been poured. However, due to the angled sidewalls 20 and flanges 22, insert 10 must be shaken or vibrated to insure that no air pockets form under insert 10.

A further limitation of insert 10 is that it is relatively time consuming to assemble due to the time required to attach nut member 14 to support member 12, and to place plastic cover 26 over slotted opening 20.

Other prior art slotted inserts use plastic nut members which can be simply snapped into place and held behind small protuberances which extend outwards from the sidewalls towards the nut member. While simplifying the installation of the nut member, these prior art devices still require the relatively labor intensive installation of the cover.

Thus, in view of the above, there is need for a slotted insert that provides a structure that does not limit the depth of the concrete cone to a value less than the height of the insert, requires less attention during installation, and requires less time to assemble.

SUMMARY OF THE INVENTION

Conventionally, slotted inserts form concrete cones which have a depth that is less than the height of the insert. The present invention, however, provides a slotted insert that forms a concrete cone which has a depth that is substantially equal to the height of the insert by utilizing a U-shaped frame with tapered feet. The increased depth of the cone, in turn, significantly increases the pull-out capability of the insert. In addition, the U-shaped frame simplifies installation of the insert, thereby eliminating the need to vibrate the insert during installation.

The slotted insert of the present invention includes a U-shaped insert frame having a base wall section with a slotted opening, a pair of sidewalls extending away from the base wall section, and a plurality of feet extending away from the sidewalls. In accordance with the present invention, the feet have a bottom surface, an edge, and a tapered region which is defined by the bottom surface and the edge. In addition, the interior surfaces of the sidewalls are formed to have indentations or, alternately, through holes.

The slotted insert also includes a nut box having a plurality of first projections positioned in register with and held by the indentations or through holes, and a second projection, which functions as a cover, that fits within the slotted opening of the base wall section. By utilizing the indentations or through holes and the first projections, assembly of the insert is accomplished by simply snapping the nut box into the frame.

In addition, the nut box includes an open box and a lid which is plastic welded to the open box. By plastic welding the lid, which has the second projection, to the box, the assembly step required to attach the prior art cover to the slot can be eliminated while at the same time providing a nut box which is completely free of contaminants.

A better understanding of the features and advantages of the present invention will be obtained by reference to the following detailed description and accompanying drawings which set forth an illustrative embodiment in which the principles of the invention are utilized.

DETAILED DESCRIPTION

FIGS. 3A–3E show a series of views that illustrate a slotted insert 100 in accordance with the present invention. As shown in FIGS. 3A–3E, slotted insert 100 includes a U-shaped insert frame 110 and a plastic nut box 112 connected to insert frame 110. FIGS. 4A–4E show a series of views that illustrate insert frame 110, while FIGS. 5A–5C show a series of views that illustrate nut box 112.

Figure 3A:
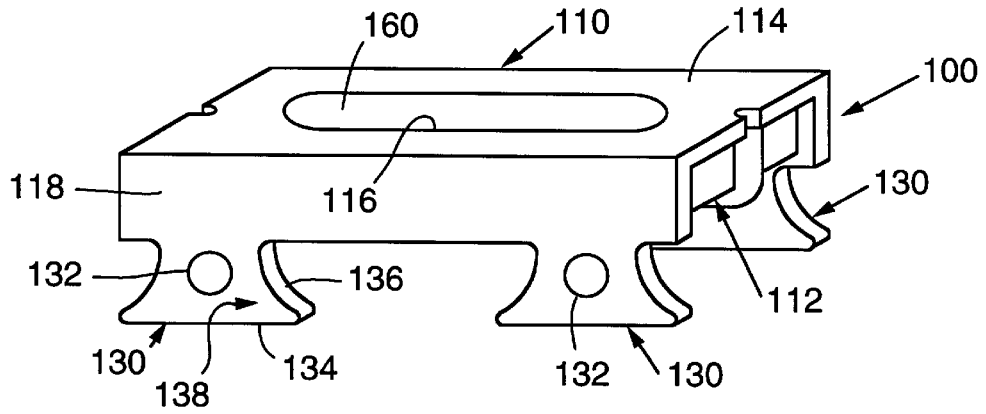
FIG. 3A is a perspective view illustrating a slotted insert 100 in accordance with the present invention.
Figure 3B:
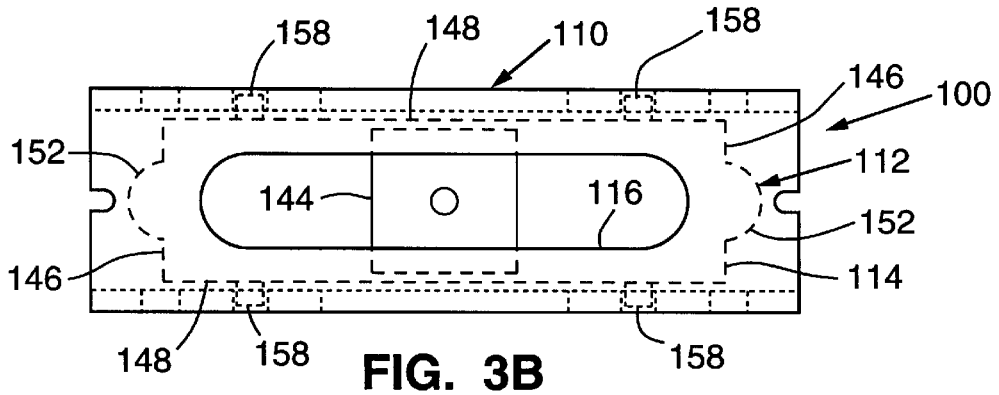
FIG. 3B is a plan view of slotted insert 100.
Figure 3C:
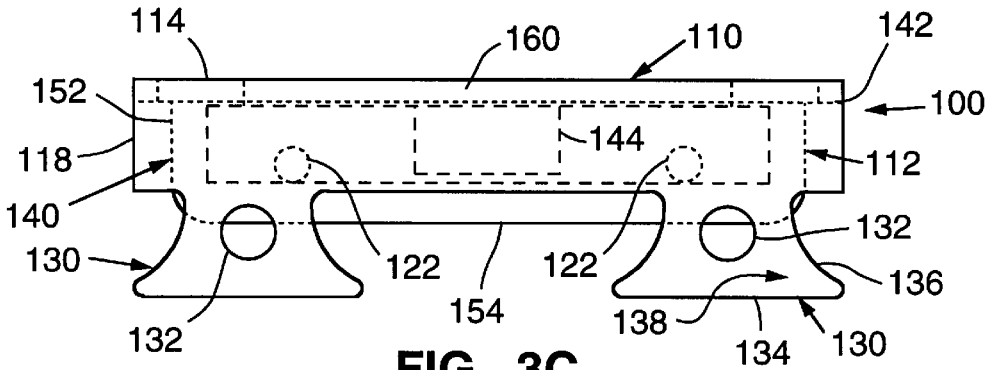
FIG. 3C is a side view of slotted insert 100 illustrating indentations 122.
Figure 3D:
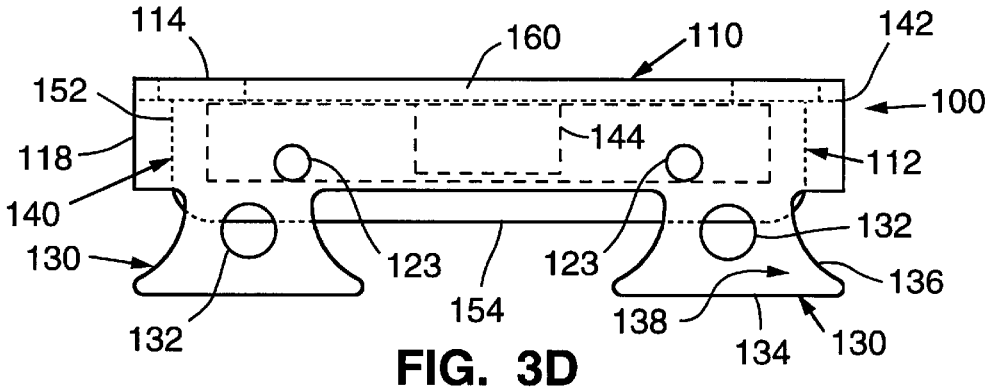
FIG. 3D is a side view of slotted insert 100 illustrating openings 123.
Figure 3E:
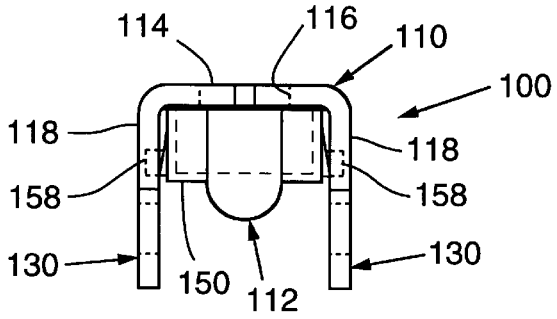
FIG. 3E is an end view of slotted insert 100.
Figure 4A:
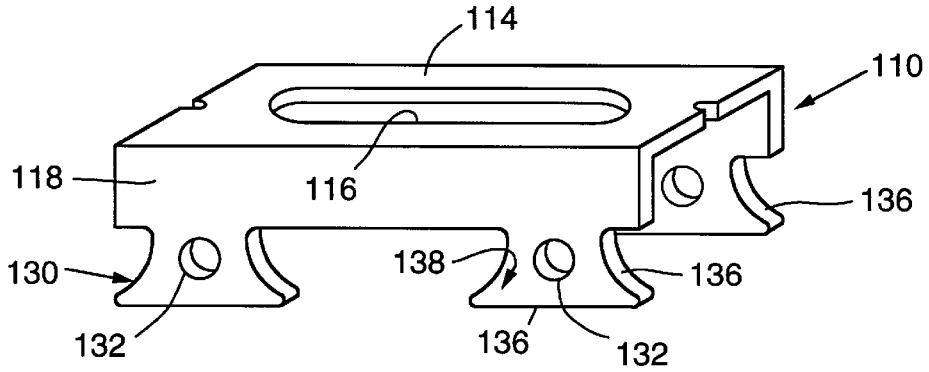
FIG. 4A is a perspective view illustrating an insert frame 110 in accordance with the present invention.
Figure 4B:
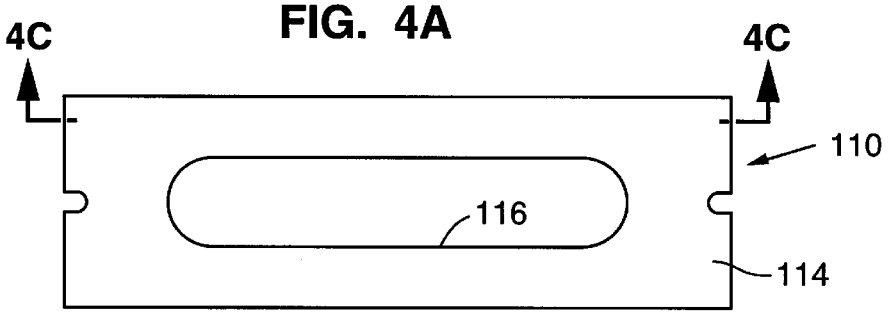
FIG. 4B is a plan view of insert frame 110.
Figure 4C:
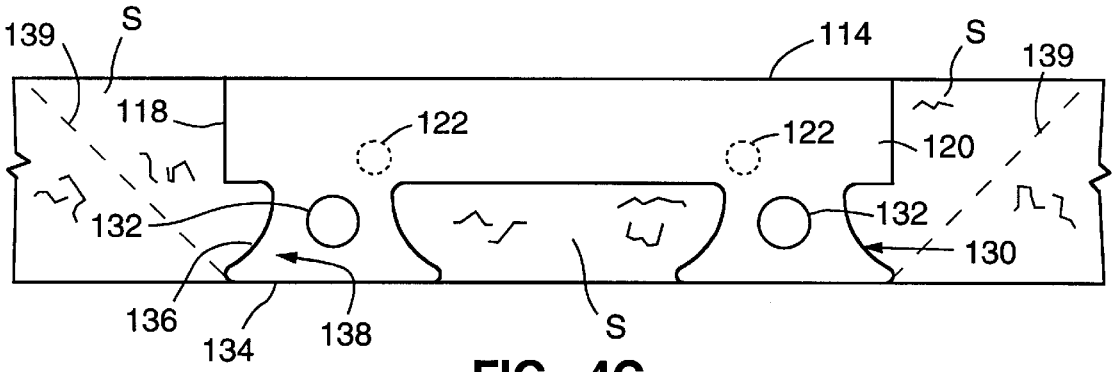
FIG. 4C is a side view of insert frame 110 taken along lines 4C—4C of FIG. 4B showing insert frame 110 embedded in a concrete slab S and indentations 122.
Figure 4D:
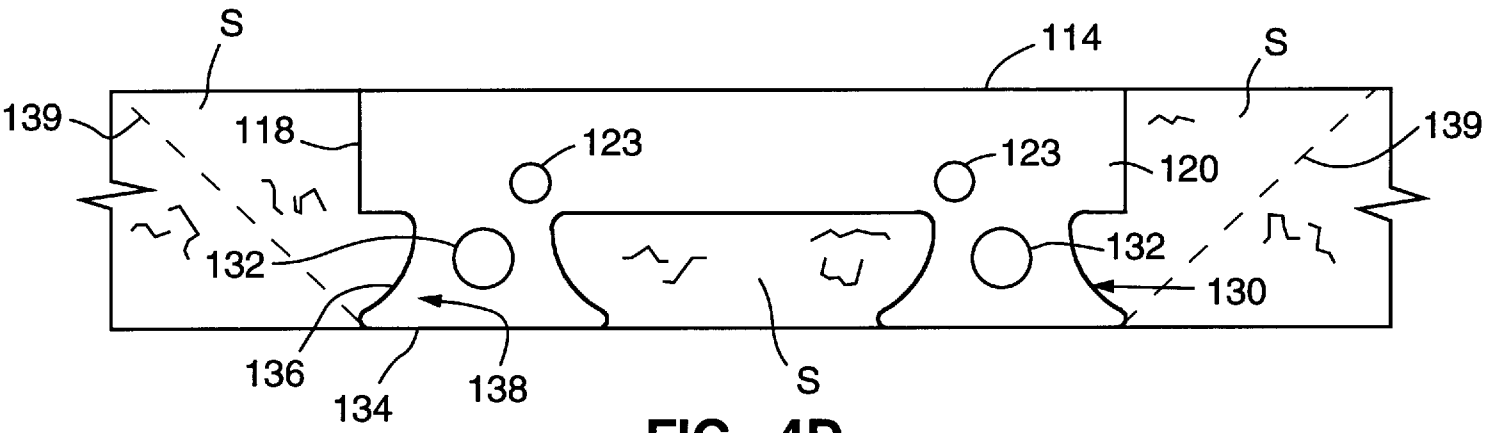
FIG. 4D is a side view of insert frame 110 taken along lines 4C—4C of FIG. 4B showing insert frame 110 embedded in a concrete slab S and openings 123.
Figure 4E:
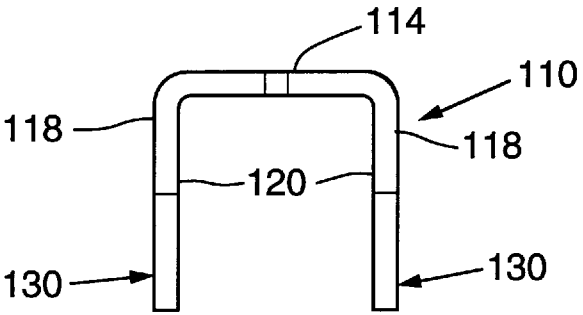
FIG. 4E is an end view of insert frame 110.
Figure 5A:
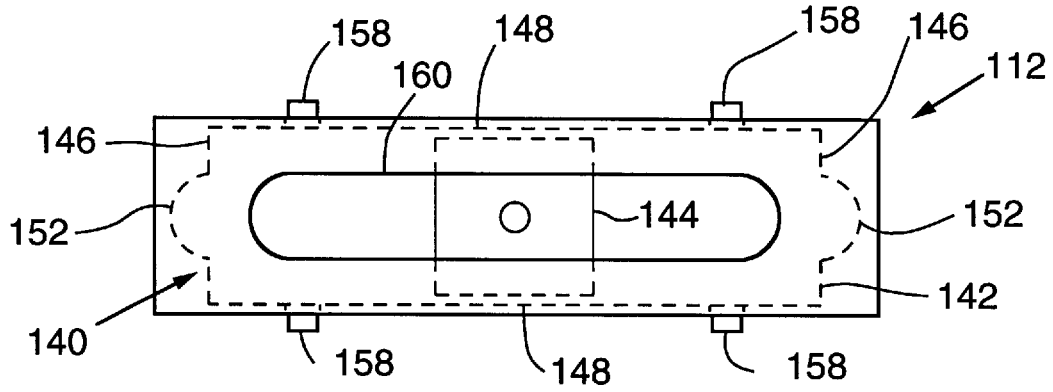
FIG. 5A is an view of nut box 112.
Figure 5B:
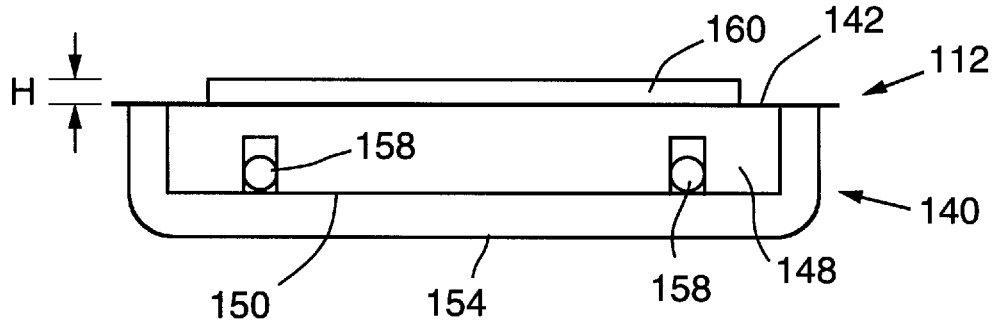
FIG. 5B is a side view of nut box 112.
Figure 5C:
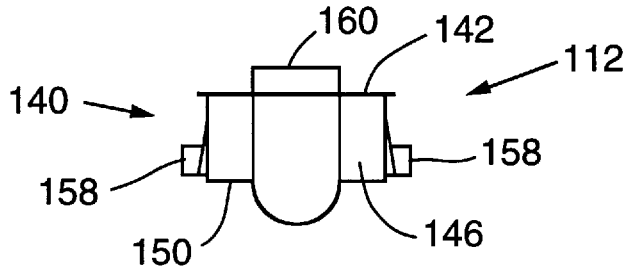
FIG. 5C is an end view of nut box 112.

As shown in FIGS. 3A–3E and 4A–4E, insert frame 110 includes a base wall section 114 that has a slotted opening 116 formed through section 114, and sidewalls 118 that extend away from opposite sides of base wall section 114 at an angle of approximately 90°. As shown in FIGS. 3C and 4C, each sidewall 118 has an inner side 120 and a pair of indentations 122 formed on the inner side 120 for securing nut box 112. Alternately, as shown in FIGS. 3D and 4D, openings 123 which are formed through sidewalls 118 can be formed in lieu of indentations 122.

In addition, insert frame 110 also includes a plurality of feet 130 that extend away from sidewalls 118 in the same plane as sidewalls 118. Each foot 130 has an opening 132 to allow reinforcing steel or other structures to be attached to insert 100, a bottom surface 134, an edge 136, and a tapered region 138 defined by bottom surface 134 and edge 136.

One of the advantages of the present invention is that tapered regions 138 provide gripping points which define a concrete cone that has a depth which is substantially equal to the height of slotted insert 100. This can be seen from FIG. 4C wherein insert frame 110 is shown embedded in a concrete slab S, and the edges of the pull-out cone are depicted by dashed lines 139 extending at approximately 45° to the surface of slab S. As there shown, the top surface of insert frame 110 is coplanar with the top surface of slab S, and feet 130 formed by the tapered regions 138 are positioned so that the bottom surfaces 134 of feet 130 are coplanar with the bottom of slab S.

Figure 1:
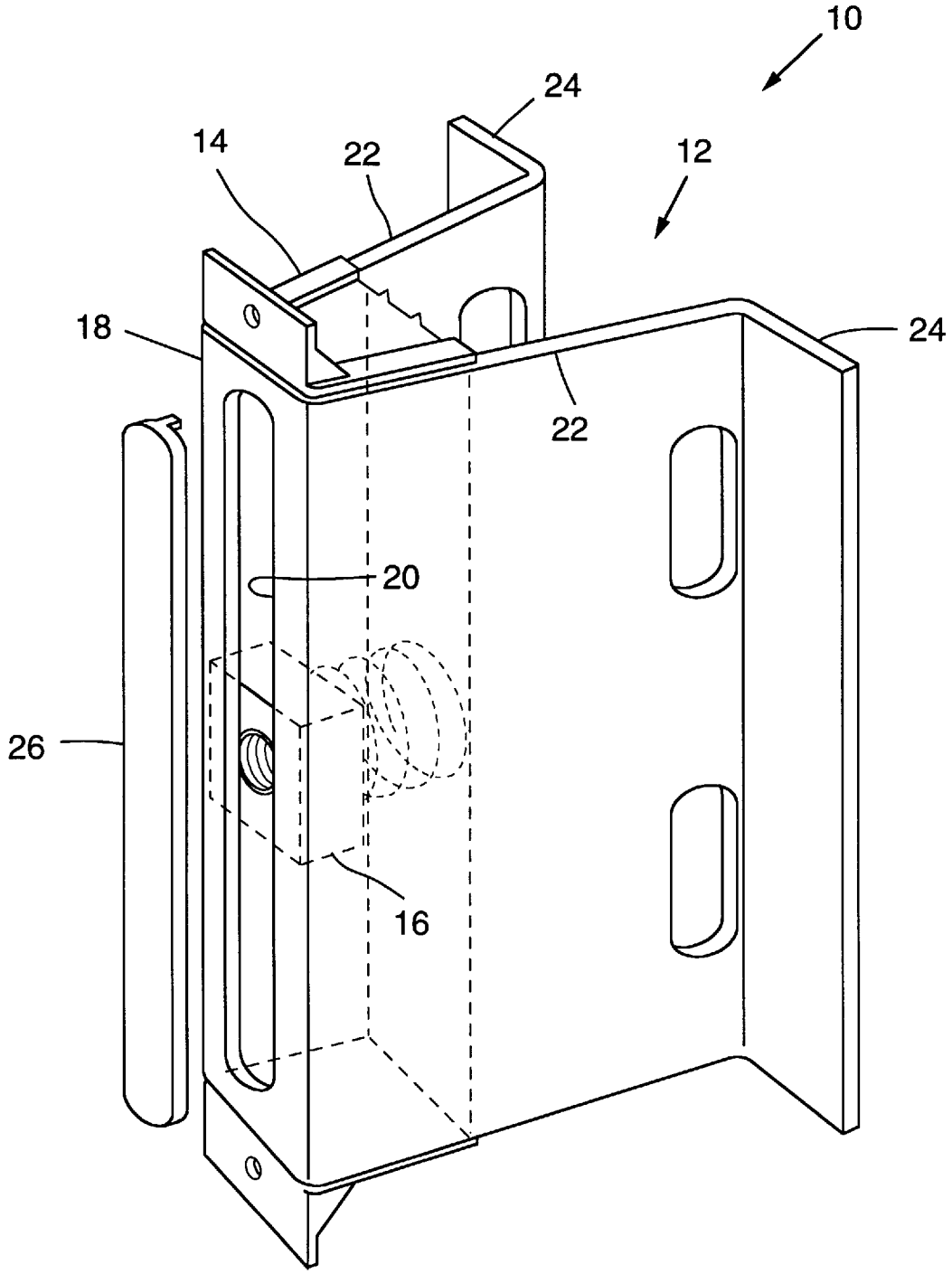
FIG. 1 (PRIOR ART)
FIG. 1 is a perspective view illustrating a prior art nut-carrying slotted insert 10.
Figure 2A:
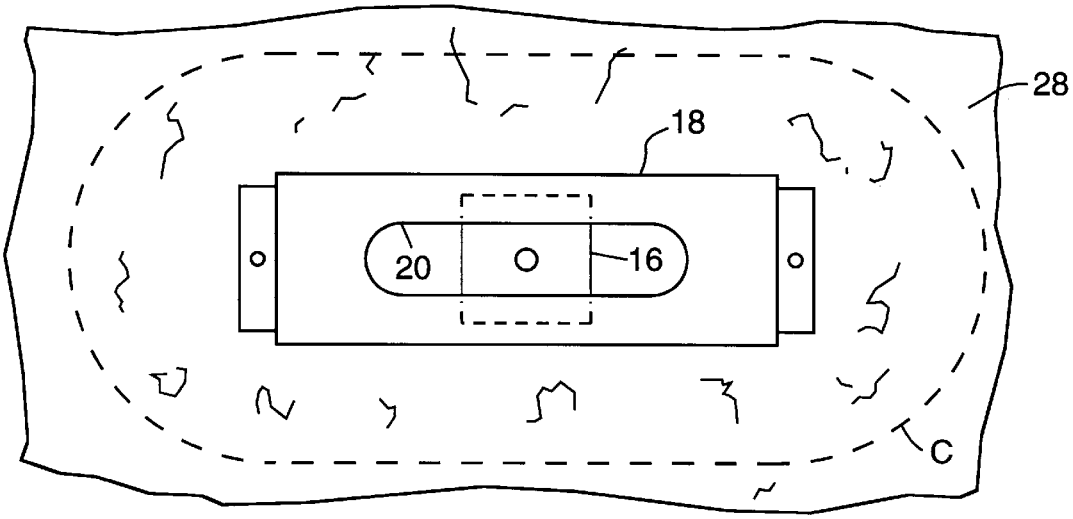
FIG. 2A (PRIOR ART)
FIG. 2A is a plan view illustrating insert 10 embedded in a concrete section 28.
Figure 2B:
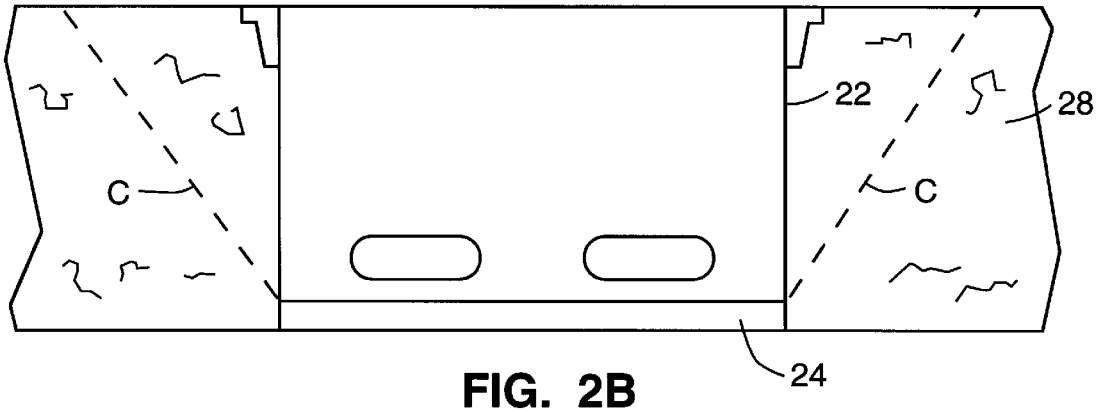
FIG. 2B (PRIOR ART)
FIG. 2B is a side view illustrating insert 10 embedded in concrete section 28.
Figure 2C:
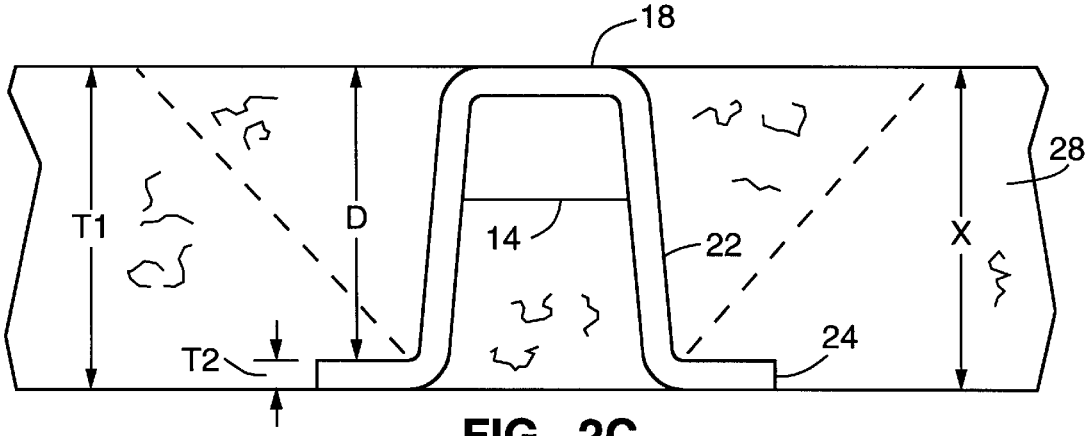
FIG. 2C (PRIOR ART)
FIG. 2C is an end view illustrating insert 10 embedded in concrete section 28.

Thus, in a flush mounted application, where both the top and bottom surfaces of insert 100 are flush with the top and bottom surfaces of the concrete, insert 100 provides greater pull-out capacity than does insert 10 of FIG. 1.

Another advantage of the present invention is that since insert frame 110 is U-shaped, insert 100 can simply be placed into previously-poured concrete without any need to vibrate the insert to remove air pockets.

Turning now to FIGS. 3A–3E and FIGS. 5A–5C, nut box 112, which is formed from PETG bubble wrap plastic or other similar materials, includes an open box 140 and a lid 142. In addition, a nut 144 may optionally be enclosed within nut box 112.

Open box 140 includes two end walls 146, two sidewalls 148 connected to end walls 146, and a bottom wall 150 connected to end walls 146 and sidewalls 148. End walls 146 and bottom wall 150 each have semicircular protrusions 152 and 154, respectively, that form a continuous channel that runs the height of end walls 146 and the length of bottom wall 150. The continuous channel, which is located at a point approximately midway between sidewalls 148, stiffens open box 140 while at the same time providing space for a bolt to extend through nut 144.

In addition, sidewalls 148 each have a pair of semi-rigid protrusions 158 which are formed to be in register with and held by the pair of indentations 122 or openings 123 when nut box 112 is connected to insert frame 110.

Another advantage of the present invention is that protrusions 158 allow nut box 112 to be connected to insert frame 110 by aligning the protrusions 158 of nut box 112 with the indentations 122 or openings 123 of insert frame 110, and then snapping nut box 112 into place. Thus, indentations 122 or openings 123 along with protrusions 158 simplify the assembly of slotted insert 100.

As further shown in FIGS. 3A–3E and FIGS. 5A–5C, lid 142 is formed to overhang end walls 146 and sidewalls 148, and to have a slot-shaped protrusion 160 that is in register with slotted opening 116 when nut box 112 is connected to insert frame 110.

Protrusion 160 functions the same as cover 26 of FIG. 1 to protect nut 144 and the interior of nut box 112. One of the advantages of utilizing protrusion 160 in lieu of a cover is that the assembly step required to install the cover can be eliminated, thereby further simplifying the assembly of slotted insert 100.

In addition, the height H of protrusion 160 is formed to be equal to the thickness of base wall section 114 so that the top of protrusion 160 is substantially flush with the outer surface of base wall section 114.

Lid 142 is permanently attached to open box 140 by means of plastic welding, gluing, or other similar approaches to seal the interior of nut box 112. One of the advantages of sealing the interior of nut box 112 is that the interior of nut box 112 remains free from contaminants which can enter prior art nut boxes through the cracks along the edges of the covers.

Thus, a slotted insert has been described which has increased pull-out capacity, simplified assembly, and simplified installation.

It should be understood that various alternatives to the embodiment of the invention described herein may be employed in practicing the invention. Thus, it is intended that the following claims define the scope of the invention and that methods and structures within the scope of these claims and their equivalents be covered thereby.

What is claimed is:

1. A concrete support structure for supporting an object on the structure, the structure comprising:

an insert frame having:

a base wall section having a slotted opening;

a pair of frame sidewalls extending away from the base wall section, a first frame sidewall of the pair of frame sidewalls being formed in a plane; and a plurality of feet extending away from the frame sidewalls, a foot of the plurality of feet having a bottom surface, an edge, and a tapered region defined by the bottom surface and the edge, the foot extending away from the first frame sidewall in the plane.

2. The structure of claim 1 wherein a frame sidewall extends away from the base wall section at an angle of substantially 90°.

3. The structure of claim 1 wherein the frame sidewalls have interior surfaces and indentations formed in the interior surfaces.

4. The structure of claim 1 wherein each foot has two tapered regions.

5. The structure of claim 1 wherein the frame sidewalls have openings formed through the sidewalls.

6. The structure of claim 5 and further comprising a nut box connected to the insert frame.

7. The structure of claim 6 wherein the nut box includes an open box having two end walls, two box sidewalls connected to the end walls, and a bottom wall connected to the end walls and the box sidewalls, the end walls and the bottom wall each having semicircular protrusions that form a continuous channel that runs the height of the end walls and the length of the bottom wall.

8. The structure of claim 7 wherein the box sidewalls have a plurality of projections positioned in register with and held by the openings in the frame sidewalls.

9. A concrete support structure for supporting an object on the structure, the structure comprising:

an insert frame having:

a base wall section having a slotted opening;

a pair of frame sidewalls extending away from the base wall section, the frame sidewalls having interior surfaces and indentations formed in the interior surfaces; and a plurality of feet extending away from the frame sidewalls, a foot of the plurality of feet having a bottom surface, an edge, and a tapered region defined by the bottom surface and the edge; and a nut box connected to the insert frame.

10. The structure of claim 9 wherein the nut box has a plurality of first projections positioned in register with and held by the indentations, and a second projection that fits within the slotted opening.

11. The structure of claim 10 wherein a top surface of the second projection and a top surface of the base wall are substantially flush.

12. The structure of claim 9 wherein the nut box includes an open box having two end walls, two box sidewalls connected to the end walls, and a bottom wall connected to the end walls and the box sidewalls, the end walls and the bottom wall each having semicircular protrusions that form a continuous channel that runs the height of the end walls and the length of the bottom wall.

13. The structure of claim 12 wherein the box sidewalls have a plurality of projections positioned in register with and held by the indentations.

14. The structure of claim 12 wherein the nut box further includes a lid connected to the open box.

15. The structure of claim 14 wherein the lid includes a projection that fits within the slotted opening.

16. The structure of claim 15 wherein a top surface of the projection and a top surface of the base wall are substantially flush.

17. The structure of claim 14 wherein the lid is permanently connected to the open box.

18. A concrete support structure for supporting an object on the structure, the structure comprising:

an insert frame having:

a base wall section having a slotted opening;

a pair of frame sidewalls extending away from the base wall section, the frame sidewalls having openings formed through the sidewalls; and a plurality of feet extending away from the frame sidewalls, a foot of the plurality of feet having a bottom surface, an edge, and a tapered region defined by the bottom surface and the edge; and a nut box connected to the insert frame, the nut box having a plurality of first projections positioned in register with and held by the openings in the frame sidewalls, and a second projection that fits within the slotted opening.

19. A concrete insert comprising a generally U-shaped insert frame having a center wall section having an opening, a pair of parallel side wall sections extending away and depending from the center wall section, a side wall section of the pair of side wall sections being formed in a plane and having a thickness, a height measured as a distance that the side wall section extends away from the center wall section, and a length, and a plurality of anchors depending from the side wall sections, an anchor of the plurality of anchors being formed in the plane and having a thickness, a height measured as a distance that the anchor extends away from the side wall section, and a length which varies from a minimum length to a maximum length, wherein the length of the side wall section is greater than the minimum length of the anchor.

20. A method for assembling a slotted insert, the method comprising the steps of:

forming an insert frame having a base wall section, a pair of sidewalls extending away from the base wall section, and a plurality of feet extending away from the sidewalls, the base wall section having a slotted opening, the sidewalls having interior surfaces with indentions;

forming an box having a plurality of first projections;

forming a lid having a second projection;

connecting the lid to the open box to form a nut box; and connecting the nut box to the insert frame so that the plurality of first projections are in register with and held by the indentions, and the second projection fits within the slotted opening.

21. The method of claim 20 wherein the lid is permanently connected to the open box.

22. The method of claim 21 wherein the lid is connected to the open box by plastic welding.

23. A nut box comprising:

an open box having two end walls, two sidewalls connected to the end walls, and a bottom wall connected to the end walls and the sidewalls, the end walls and the bottom wall each having semicircular protrusions that form a continuous channel that runs the height of the end walls and the length of the bottom wall; and a lid permanently attached to the open box, the lid having a projection.

24. In combination with a concrete slab having upper and lower surfaces, an improved insert for facilitating attachment to the slab comprising:

a metallic body imbedded in the slab, said body being of a generally inverted U-shaped configuration and having an upper section coplanar with the upper surface of the slab and side walls depending from the upper section and extending into the slab;

feet coplanar with and formed as part of the side walls, said feet terminating in undersurfaces coplanar with the lower surface of the slab; and, convergent surfaces extending from the undersurfaces of the feet into the side walls to resist pull-out of the insert from the slab.

25. In a combination according to claim 24, the improved insert wherein the convergent surfaces are of a concave curvilinear configuration to direct pull-out forces into the slab at approximately 45 degrees to the upper surface of the slab.

26. In a combination according to claim 24, the improved insert wherein the side walls are generally parallel to one another and normal to the upper section.

27. In a combination according to claim 24, the improved insert further comprising:

a slot formed through the upper section; and, a closed nut box received within the body between the sidewalls and in juxtaposition to the upper section to close the slot.

28. In a combination according to claim 27 wherein the nut box if formed with a upper side juxtaposed to the upper section, said upper side being frangible through the slot to afford access to the interior of the box.

29. In a combination according to claim 28 wherein the nut box is formed of a polymeric material and interengageable securing means are formed on the box and the side walls to hold the nut box in juxtaposition to the upper section.

30. A concrete insert comprising:

a generally U-shaped insert frame having a center wall section having an opening, a pair of side wall sections extending away and depending from the center wall section, a side wall section having an interior surface and an opening formed in the interior surface, and a plurality of anchors depending from the side wall sections, and a fastener box having a projection positioned in register with and held by the opening in the side wall section.

31. The insert of claim 30 and further comprising a lid connected to the fastener box, the lid having a projection that fits within the opening in the center wall section.

32. The insert of claim 30 wherein the fastener box includes two end walls, two box side walls connected to the end walls, and a bottom wall connected to the end walls and the box side walls, the end walls and the bottom wall each having semicircular protrusions that form a continuous channel that runs the height of the end walls and the length of the bottom wall.

* * * * *